US006909245B2

(12) United States Patent
Van Der Veen et al.

(10) Patent No.: US 6,909,245 B2
(45) Date of Patent: Jun. 21, 2005

(54) BALLAST CIRCUIT FOR CONTROL OF LAMP POWER

(75) Inventors: Geert Willem Van Der Veen, Eindhoven (NL); Everaard Marie Jozef Aendekerk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 3 days.

(21) Appl. No.: 10/280,647

(22) Filed: Oct. 25, 2002

(65) Prior Publication Data

US 2003/0102821 A1 Jun. 5, 2003

(30) Foreign Application Priority Data

Oct. 29, 2001 (EP) ..... 01204131

(51) Int. Cl.[7] ..... H05B 37/02
(52) U.S. Cl. ..... 315/224; 315/291; 315/307
(58) Field of Search ..... 315/200 R, 208, 315/224, 226, 241 R, 246, 283, 287, 291, 293, 307, DIG. 4, DIG. 7; 363/74, 126–127, 131

(56) References Cited

U.S. PATENT DOCUMENTS 4,230,971 A 10/1980 Gerhard et al. ..... 315/307
4,949,016 A * 8/1990 De Bijl et al. ..... 315/208
5,111,118 A 5/1992 Fellows et al. ..... 315/307
5,396,155 A 3/1995 Bezdon et al. ..... 315/291
5,491,388 A * 2/1996 Nobuyuki et al. ..... 315/308
5,502,423 A * 3/1996 Okude et al. ..... 315/291
5,559,395 A 9/1996 Venkitasubrahmanian et al. ..... 315/247
5,608,294 A * 3/1997 Derra et al. ..... 315/224
6,051,935 A * 4/2000 Bucks et al. ..... 315/224
6,191,568 B1 * 2/2001 Poletti ..... 323/268
6,515,882 B2 * 2/2003 Moriguchi et al. ..... 363/97

FOREIGN PATENT DOCUMENTS

EP 0821546 A2 1/1998 ..... H05B/41/29

* cited by examiner

*Primary Examiner*—Thuy Vinh Tran

(57) ABSTRACT

A ballast circuit for operating a discharge lamp equipped with a control loop for controlling the power consumed by the lamp. A first circuit part is coupled to the discharge lamp and to input terminals for connection to a source of supply voltage for the ballast circuit. The first circuit part is coupled to the input terminals to supply lamp current from the supply voltage. The control loop includes a second circuit part coupled to the first circuit to generate a first signal that represents a desired value of lamp power. A third circuit part is coupled to the input terminals for generating a second signal that depends on the amplitude of the supply voltage. A fourth circuit part has an input coupled to the third circuit part and an output coupled to an input of the second circuit part for adjusting the value of the first signal dependent upon the second signal. The power consumed by the lamp is decreased when the amplitude of the supply voltage decreases. Too high currents in the ballast circuit are thereby prevented.

19 Claims, 1 Drawing Sheet

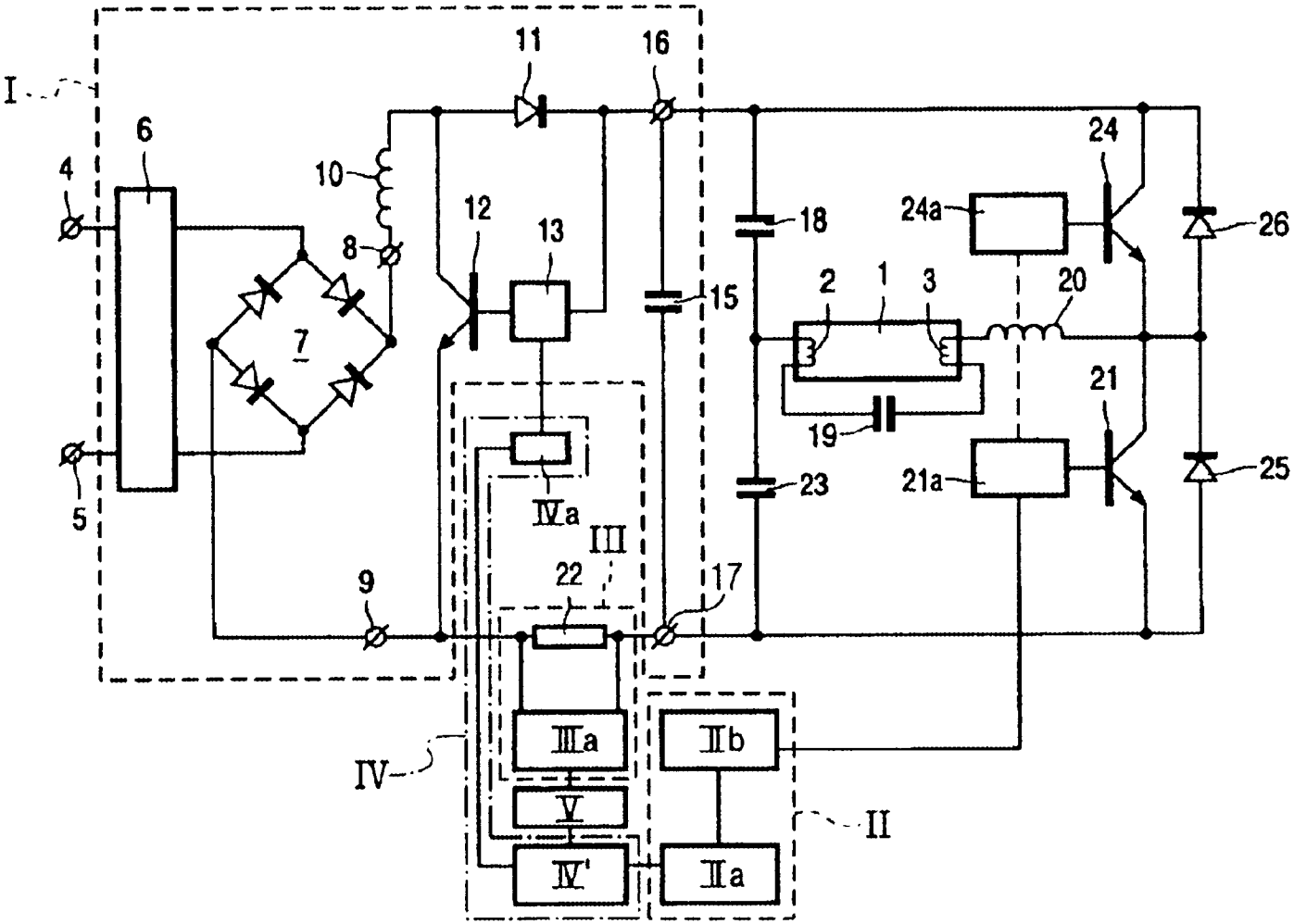
26
25
24
21
20
24a
21a
3
1
2
19
18
23
II
IIb
IIa
15
17
16
III
IIIa
V
IV'
IVa
22
13
11
12
IV
10
8
9
7
6
4
5
I

BALLAST CIRCUIT FOR CONTROL OF LAMP POWER

BACKGROUND OF THE INVENTION

This invention relates to a circuit arrangement for operating a lamp comprising

- input terminals for connection to the poles of a supply voltage source,
- a circuit part I coupled to the input terminals for generating a current through the lamp from a supply voltage delivered by the, supply voltage source, and
- a circuit part II coupled to the circuit part I for controlling the power consumed by the lamp, and comprising a circuit part IIa for generating a first signal that represents a desired value of the power consumed by the lamp.

Such a circuit arrangement is known from U.S. Pat. No. 5,111,118. In the known circuit arrangement the circuit part II makes sure that the power consumed by the lamp is hardly influenced by a change in operational parameters such as the amplitude of the supply voltage. In case the amplitude of the supply voltage decreases the amplitude of the current drawn from supply voltage has to increase. However, if the amplitude of this supply current increases too much this increase can lead to damage to components of circuit part I. More in particular, in case the circuit part I comprises a DC-DC-converter, such as an up-converter, operating in the transition mode, an increase of the average current drawn from the supply voltage source corresponds to an increase the maximal amplitude of the current drawn from the supply voltage source that is twice as big. In this latter case damage to components can even happen when the decrease in the amplitude of the supply voltage is relatively small.

SUMMARY OF THE INVENTION

The invention aims to provide a circuit arrangement for operating a lamp, wherein the lamp power can be maintained at a desired level over a relatively wide range of the amplitude of the supply voltage and which prevents damage to components in the circuit arrangement in case of a very low amplitude of the supply voltage.

A circuit arrangement as described in the opening paragraph is therefor in accordance with the invention characterized in that the circuit arrangement is further equipped with

- a circuit part III coupled to the input terminals for generating a second signal that depends on the amplitude of the supply voltage, and
- a circuit part IV coupled with circuit part III and circuit part IIa for adjusting the value of the first signal dependent upon the second signal.

In case the amplitude of the supply voltage becomes very low, the circuit part IV adjusts the value of the first signal in such a way that the amount of power consumed in the lamp is reduced. As a consequence the amplitude of the current drawn from the supply voltage source decreases so that damage to the components of circuit part I is prevented.

The second signal generated by circuit part III can for instance be proportional to the amplitude of the supply voltage. Alternatively, however, the second signal can for instance be proportional to the amplitude of the current drawn from the supply voltage source. In the latter case the second signal increases, when the amplitude of the supply voltage decreases.

In a first preferred embodiment of a circuit arrangement according to the present invention, the circuit part IV comprises means to decrease the desired value of the power consumed by the lamp in case the amplitude of the supply voltage decreases and to increase the desired amount of power consumed by the lamp in case the amplitude of the supply voltage increases. In this first preferred embodiment the lamp operated by the circuit arrangement always provides as much light as is possible for the prevailing value of the amplitude of the supply voltage.

In a second preferred embodiment of a circuit arrangement according to the invention, the circuit arrangement, comprises a circuit part V coupled between the circuit part III and the circuit part IV for activating the circuit part IV when the amplitude of the supply voltage decreases below a predetermined value and for deactivating circuit part IV when the amplitude of the supply voltage increases above the predetermined value. The predetermined value of the amplitude of the supply voltage can be chosen so that it corresponds to a value of the amplitude of the supply voltage below which damage to the components of circuit part I would occur if the power consumed by the lamp would remain the same.

In a third preferred embodiment of a circuit arrangement according to the invention, the circuit part IV comprises a circuit part IVa for switching the circuit arrangement off, in case the amplitude of the supply voltage decreases below a further predetermined value. In case the amplitude of the supply voltage drops below the further predetermined value, the corresponding value of the power consumed by the lamp is so low that stable operation of the lamp is impossible. The circuit part IVa comprised in the circuit part IV of the third preferred embodiment therefor switches the circuit arrangement off. In this third preferred embodiment unstable lamp operation and a too high amplitude of the current drawn from the supply voltage source are both prevented. In case the circuit arrangement comprises a DC-DC-converter, such as an up-converter, the switching off of the circuit arrangement can be effected by very simple means in case the circuit part IVa comprises a circuit part IVb for switching the DC-DC-converter off. In many practical embodiments of a circuit arrangement according to the invention the circuit part I comprises a DC-DC-converter and a DC-AC-converter. The DC-AC-converter is often implemented as a bridge circuit. In such a practical embodiment, the operation of the circuit arrangement can be stopped by switching off the bridge circuit. This can be effected by switching off the control of the switches incorporated in the bridge circuit. It has been found, however, that after the bridge has been switched off, the DC-DC-converter does not completely stop functioning but enters into an erratic mode of operation causing for instance audible noise. This can be prevented if the operation of the circuit arrangement is stopped by switching the DC-DC-converter off. This can be effected by switching off the control of the switch in corporated in the DC-DC-converter.

Preferably the circuit part IV comprises a microprocessor equipped with a memory that stores a relation between the first signal and the second signal. In this way an effective and dependable operation of the circuit arrangement according to the invention is obtained. This relation can for instance be stored as a table relating values of the second signal to values of the first signal. Alternatively the relation can also be stored in the form of parameters defining a polynome that expresses the value of the first signal as a function of the second signal.

BRIEF DESCRIPTION OF THE DRAWING

An embodiment of a circuit arrangement according to the invention will be explained making reference to a drawing.

The drawing shows an embodiment of a circuit arrangement according to the invention with a discharge lamp 1 connected to it.

In the drawing, 4 and 5 are input terminals for connection to the poles of a supply voltage source. Input terminals 4 and 5 are connected with respective input terminals of filter 6. A first output terminal of filter 6 is connected to a first input terminal of diode bridge 7. A second output terminal of filter 6 is connected to a second input terminal of diode bridge 7. A first output terminal 8 of diode bridge 7 is connected to a second output terminal 9 of diode bridge 7 by means of a series arrangement of choke 10 and switching element 12. switching element 12 is shunted by means of a series arrangement of diode 11, capacitor 15 and ohmic resistor 22. A control electrode of switching element 12 is connected to an output terminal of circuit part 13. Circuit part 13 is a control circuit for alternately rendering switching element 12 conductive and non-conductive. Choke 10, switching element 12, circuit part 13, diode 11 and capacitor 15 together form a DC-DC-converter of the up-converter type. An input terminal of circuit part 13 is connected to a common terminal 16 of diode 11 and capacitor 15. This common terminal 16 also forms a first output terminal of the DC-DC-converter. The side of capacitor 15 that is connected to ohmic resistor 22 forms the second output terminal 17 of the DC-DC-converter.

Output terminals 16 and 17 are connected by means of a series arrangement of capacitor 18 and capacitor 23. The series arrangement of capacitor 18 and capacitor 23 is shunted by a series arrangement of switching element 24 and switching element 21. Switching element 24 is shunted by diode 26. Switching element 21 is shunted by diode 25. A common terminal of capacitors 18 and 23 is connected to a common terminal of switching elements 24 and 21 by means of a series arrangement of a first lamp electrode 2, capacitor 19, second lamp electrode 3 and choke 20. An output terminal of circuit part 21*a* is connected to a control electrode of switching element 21. An output terminal of circuit part 24*a* is connected to a control electrode of switching element 24. Circuit parts 21*a* and 24*a* are control circuits for rendering the switching elements 21 and 24 alternately conducting and non-conducting. An output terminal of circuit part IIb is connected both to an input terminal of circuit part 21*a* and to an input terminal of circuit part 24*a*. An input terminal of circuit part IIb is connected to an output terminal of circuit part IIa. Circuit parts IIa and IIb together form a circuit part II for controlling the power consumed by the lamp at a predetermined value P1. IIa is a circuit part for generating a first signal that represents a desired value of the power consumed by the lamp. Circuit part IIb is the remaining part of circuit part II. Respective ends of ohmic resistor 22 are connected to respective input terminals of circuit part IIIa. Circuit part IIIa and ohmic resistor 22 together form a circuit part III for generating a second signal that depends on the current taken from the supply voltage source and therefore also depends on the amplitude of the supply voltage. An output terminal of circuit part IIIa is connected to an input terminal of circuit part V. An output terminal of circuit part V is connected to an input terminal of circuit part IV'. A first output terminal of circuit part IV' is connected to an input terminal of circuit part IIa. A second output terminal of circuit part IV' is connected to an input terminal of circuit part IVa. Circuit part IVa is a circuit part for switching the circuit arrangement off. In this embodiment circuit part IVa is also a circuit part IVb for switching off the DC-DC-converter. An output terminal of circuit part IVa is connected to an input terminal of circuit part 13. Circuit part IV' together with circuit part IVa forms a circuit part IV for adjusting the value of the first signal in dependency of the second signal. Circuit part IV comprises a microprocessor equipped with a memory that stores the relation between the first signal and the second signal. In the embodiment shown in FIG. 1 this relation is stored as a table relating values of the second signal to values of the first signal. For any particular value of the second signal the corresponding value of the first signal can be found by interpolation. Circuit part V is a circuit part for activating circuit part IV in case the amplitude of the supply voltage decreases below a predetermined value and for deactivating circuit part IV in case the amplitude of the supply voltage increases above said predetermined value.

The operation of the embodiment shown in the drawing is as follows.

The supply voltage source suitable for the embodiment shown in the drawings is the AC mains supply. The supply voltage delivered by the supply voltage source is a low frequency sinusoidal voltage. When input terminals 4 and 5 are connected to the poles of such a supply voltage source, the supply voltage is rectified by means of the diode bridge 7. The rectified supply voltage is present between output terminals 8 and 9. Switching element 12 is rendered conductive and non-conductive at a high frequency by means of a control signal that is generated by circuit part 13. Thus, a DC voltage that is present across capacitor 15 is generated out of the rectified supply voltage by the DC-DC-converter. The amplitude of the DC-voltage that is present on capacitor 15 is higher than the amplitude of the supply voltage and is controlled at a substantially constant value by circuit part 13 by means of adjustment of the duty cycle and/or the frequency of the control signal generated by circuit part 13. The circuit parts 21*a* and 24*a* render the switching elements 21 and 24 alternately conducting and non-conducting at a frequency f. As a result a substantially square wave shaped voltage with frequency f is present at the common terminal of switching elements 21 and 24. This substantially square wave shaped voltage in turn causes an AC current at the frequency f to flow through choke 20 and the parallel arrangement of lamp 1 and capacitor 19. Circuit part IIa generates a first signal that represents a desired value of the power consumed by the lamp 1. Circuit part IIb controls the duty cycle and/or the frequency of the control signal generated by circuit parts 21*a* and 24*a* in such a way that the actual power consumed by the lamp is substantially equal to the desired value of the power.

In case the amplitude of the supply voltage decreases and the amount of power consumed by the lamp remains the same, the necessary consequence of this decrease in the amplitude of the supply voltage is an increase in the amplitude of the current drawn from the supply voltage source. This increase causes an increase in the amplitude of the voltage over ohmic resistor 22. In response to that the second signal that is present at the output terminal of circuit part IIIa is also increased. In case the amplitude of the supply voltage has not decreased below a predetermined value, circuit part IV remains unactivated and the increase in the amplitude of the current drawn from the supply voltage source is not counteracted. In case the amplitude of the supply voltage decreases below the predetermined value, however, circuit part V activates circuit part IV. Circuit part IVa adjusts the value of the first signal in such a way that the power consumed by the lamp is decreased. This adjustment causes the amplitude of the current drawn from the supply voltage source to decrease. As a net result the current drawn from the supply voltage source does not increase when the amplitude of the supply voltage decreases below the predetermined value so that the components of the circuit arrangement are effectively protected. In case the amplitude of the supply voltage decreases further, circuit part IV will further decrease the power consumed by the lamp. In case, however, the amplitude of the supply voltage decreases below a further predetermined value the circuit part IVa switches the circuit part 13 off so that the operation of the circuit arrangement is terminated. This further predetermined value corresponds to a value of the power consumed by the lamp that is so low that stable lamp operation is no longer possible. Unstable lamp operation is thus prevented by the circuit part IVa.

In case the amplitude of the supply voltage has decreased below the predetermined level and at a later stage increases but remains lower than the predetermined value, the circuit part IVa adjusts the first signal in such a way that the power consumed by the lamp is increased. The amplitude of the current drawn from the supply voltage source increases as a result but remains below a value at which damage to components could occur. In case the amplitude of the supply voltage increases above the predetermined value, the circuit part V deactivates the circuit part IV so a further increase of the amplitude of the supply voltage will not result in changes in the amount of power consumed by the lamp. The predetermined value of the amplitude of the supply voltage can be chosen so that it corresponds to a value of the amplitude of the supply voltage below which damage to the components of circuit part I will occur.

What is claimed is:

1. A circuit arrangement for operating a lamp, said circuit arrangement comprising: input terminals for connection to a source of supply voltage, a circuit part I coupled to the input terminals for producing a current through the lamp from the source, a circuit part II coupled to the circuit part I for controlling power consumed by the lamp comprising a circuit part IIa for generating a first signal that represents a desired value of power consumed by the lamp, a circuit part III coupled to the input terminals for generating a second signal that depends on an amplitude of the supply voltage, and a circuit part IV coupled to the circuit part III and the circuit part IIa for adjusting the value of the first signal dependent upon the second signal.

2. The circuit arrangement according to claim 1, wherein the circuit part IV comprises means for decreasing the desired value of the power consumed by the lamp in case the amplitude of the supply voltage decreases and for increasing the desired amount of power consumed by the lamp in case the amplitude of the supply voltage increases.

3. The circuit arrangement as claimed in claim 2 further comprising a circuit part V coupled between the circuit part III and the circuit part IV for activating the circuit part IV when the amplitude of the supply voltage decreases below a predetermined value and for deactivating circuit part IV when the amplitude of the supply voltage increases above the predetermined value.

4. The circuit arrangement according to claim 1, further comprising a circuit part V coupled between the circuit part III and the circuit part IV for activating the circuit part IV when the amplitude of the supply voltage decreases below a predetermined value and for deactivating circuit part IV when the amplitude of the supply voltage increases above the predetermined value.

5. The circuit arrangement according to claim 1, wherein the circuit part IV comprises a circuit part IVa for switching the circuit arrangement off, in case the amplitude of the supply voltage decreases below a further predetermined value.

6. The circuit arrangement according to claim 5, wherein the circuit arrangement further comprises a DC-DC-converter and wherein the circuit part IVa comprises a circuit part for switching the DC-DC-converter off.

7. The circuit arrangement as claimed in claim 4 wherein the circuit part IV comprises a circuit part IVa for switching the circuit arrangement off if the amplitude of the supply voltage decreases below a further predetermined value.

8. The circuit arrangement according to claim 1, wherein the circuit part IV comprises a microprocessor equipped with a memory that stores a relation between the first signal and the second signal.

9. The circuit arrangement as claimed in claim 1 wherein the circuit part IV comprises means for controlling the first signal so as to adjust lamp power as a function of the supply voltage.

10. The circuit arrangement as claimed in claim 1 wherein the lamp comprises a discharge lamp.

11. A circuit for operating a discharge lamp, said circuit comprising: first and second input terminals for connection to a source of supply voltage, first and second output terminals for connection to the discharge lamp, first circuit means coupled to the input terminals and output terminals for supplying current to a connected discharge lamp from said source, second circuit means coupled to the first circuit means for controlling lamp power by means of a first signal, third circuit means, connected in the circuit, for generating a second signal that depends on an amplitude of the supply voltage, and fourth circuit means having an input coupled to an output of the third circuit means and an output coupled to an input of the second circuit means so as to control the first signal dependent upon the second signal.

12. The discharge lamp operating circuit as claimed in claim 11 wherein the fourth circuit means includes means for decreasing lamp power if the amplitude of the supply voltage decreases below a predetermined value and for regulating the lamp power when the supply voltage is above said predetermined value.

13. The discharge lamp operating circuit as claimed in claim 12 wherein the fourth circuit means includes means for switching the circuit off if the amplitude of the supply voltage decreases below a predetermined value.

14. The discharge lamp operating circuit as claimed in claim 11 wherein said circuit comprises first and second switching transistors coupled to the output terminals for supplying an alternating current to a connected lamp, and control circuit means controlled by the first signal and coupled to control terminals of the first and second switching transistors and operative to control the lamp power via said first and second switching transistors.

15. The discharge lamp operating circuit as claimed in claim 11 wherein the first circuit means includes a DC/DC converter coupled to the input terminals and to the output terminals, and the fourth circuit means includes means for switching the DC/DC converter off if the amplitude of the supply voltage decreases below a predetermined value.

16. The discharge lamp operating circuit as claimed in claim 11 wherein the fourth circuit means comprises a microprocessor having a memory with a table that stores values of the second signal related to corresponding values of the first signal.

17. The discharge lamp operating circuit as claimed in claim 11 further comprising fifth circuit means coupled to the third circuit means and to the fourth circuit means for activating the fourth circuit means if the amplitude of the supply voltage decreases below a predetermined value and for deactivating the fourth circuit means when the amplitude of the supply voltage is above said predetermined value.

18. The discharge lamp operating circuit as claimed in claim 11 further comprising means coupled to at least one output terminal for deriving a control voltage determined by lamp current, and wherein the third circuit means is controlled by said control voltage to generate the second signal.

19. The discharge lamp operating circuit as claimed in claim 11 wherein the first signal is derived by the second circuit means in a manner that is not directly dependent upon an ambient temperature in which the circuit is operative.

* * * * *